United States Patent [19]

Peterson et al.

[11] Patent Number: 4,648,830

[45] Date of Patent: Mar. 10, 1987

[54] SPINNERETTE FOR PRODUCING HOLLOW TRILOBAL CROSS-SECTION FILAMENT

[75] Inventors: Weldon H. Peterson, Colonial Heights; Kenneth G. Morrison, Chester, both of Va.

[73] Assignee: Allied Corporation, Morris Township, Morris County, N.J.

[21] Appl. No.: 733,300

[22] Filed: May 13, 1985

[51] Int. Cl.[4] ..... D01D 5/24

[52] U.S. Cl. ..... 425/464; 264/177.1; 425/465

[58] Field of Search ..... 428/397, 398; 264/177 R, 177 F; 425/461, 464, 465, 376 R, 382 R, 382.2, 131.5, 725

[56] References Cited

U.S. PATENT DOCUMENTS

| | | | |
|---|---|---|---|
| 3,109,220 | 11/1963 | McKinney et al. | 428/397 |
| 3,121,040 | 2/1964 | Shaw et al. | 264/177 F |
| 3,745,061 | 7/1973 | Champaneria et al. | 428/398 |
| 3,981,948 | 9/1976 | Phillips | 428/398 |
| 4,279,053 | 7/1981 | Payne et al. | 428/398 |
| 4,316,924 | 2/1982 | Minemura et al. | 428/397 |

FOREIGN PATENT DOCUMENTS

| | | | |
|---|---|---|---|
| 1071364 | 2/1980 | Canada | 264/177 F |
| 43-5166 | 2/1968 | Japan | 425/461 |
| 843179 | 8/1960 | United Kingdom | 428/398 |
| 1099258 | 1/1968 | United Kingdom | 264/177 F |

*Primary Examiner*—Jay H. Woo
*Assistant Examiner*—J. Fortenberry
*Attorney, Agent, or Firm*—Richard A. Anderson

[57] ABSTRACT

This invention is a trilobal, synthetic fiber, intended for use in carpets, having an axially extending hole in each lobe, the total cross-sectional area of the fiber being about 5 to 12 percent void, said fiber cross-section having a modification ratio of between about 2 to 3, and an arm angle of about 15° to 45°, so that a fiber having improved bulk, soil hiding and resiliency is apparent in a carpet having face fiber of said fiber.

2 Claims, 1 Drawing Figure

SPINNERETTE FOR PRODUCING HOLLOW TRILOBAL CROSS-SECTION FILAMENT

BACKGROUND OF THE INVENTION

This invention relates to a hollow trilobal cross-section filament for use as carpet yarn, and to a spinnerette for its manufacture.

It is known to make trilobal filaments with axial holes in the lobes and in the center of the cross-section in U.S. Pat. No. 3,493,459, hereby incorporated by reference. Such filaments or fibers, which may remain continuous or may be cut to staple, may be spun from the conventional synthetic polymers, such as nylon, polyester or polyolefin polymers. For example nylon 6, nylon 6,6, nylon 4, nylon 610, nylon 11 and their copolymers; polyethylene terephthalate and other related carboxylic acid-alkylene glycol polyesters; polyethylene, polypropylene and other similar polymers can be used.

The prior art hollow fibers or filaments may have improved sparkle and/or luster, but resiliency, bulk and soil-hiding ability of the fiber were not known to have improved.

It is an object of this invention to provide a spinnerette which creates a fiber or filament with a cross-section which when tuffed into carpet will provide improved bulk, soil hiding and resiliency which is apparent in the carpet.

SUMMARY OF THE INVENTION

In one aspect this invention is a trilobal synthetic fiber intended for use in carpets having an axially extending hole in each lobe, the total cross-sectional area of the fiber being about 5 to 12 percent void, the fiber cross-section having a modification ratio of between about 2 to 3, and an arm angle of about 15° to 45°, so that a fiber having an improved bulk, soil hiding and resiliency is apparent in a carpet having face fiber of the fiber. It is preferred the fiber be made of nylon, preferably nylon 6 or nylon 6,6. The preferred modification ratio is between about 2.2 and 2.8.

In another aspect this invention is a spinnerette plate for the manufacture of trilobal fiber with a hole in each lobe, said spinnerette having at least one filament forming bore group having three openings, each of said openings being "Y" shaped with one short leg and the axis of each short leg converging on the center of the bore group, and each of the long legs of the same "Y" being divergent from each other by an angle of at least 130° to 150°. It is preferred that the divergent angle be about 140° and the ratio of the length of one of the long legs to the length of the short leg being between about 3:1 and 15:1.

Figure 1:
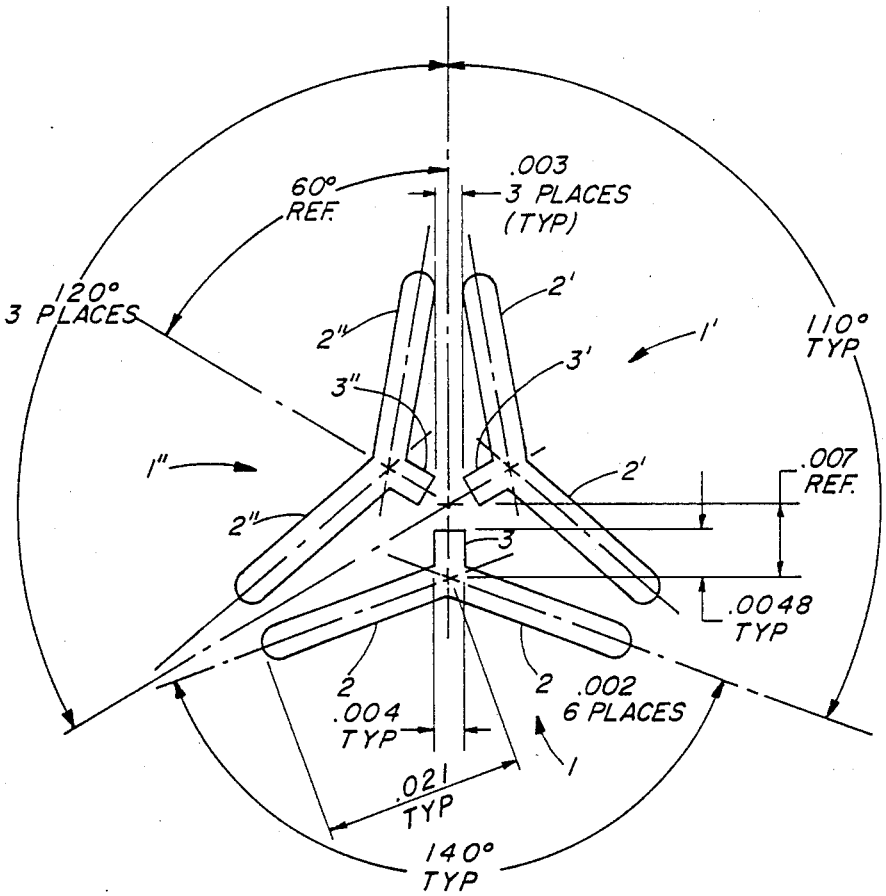
FIG. 1 is a plan view of one filament forming bore group embodiment of the spinnerette of this invention.

The bore group consists of three "Y" shaped holes, 1, 1' and 1'' each having long legs 2, 2' and 2'' and short legs 3, 3' and 3''. The angle between the legs 2 is typically 140°. Leg 3 is typical 0.0048 inches while leg 2 is typically 0.0021 inches. The width of each leg is typically 0.004 inches and a clearance between legs 2, and 2' is typically 0.003 inches, while clearance between leg 3 and 3' is typically 0.007 inches.

Although any filament count yarn can be manufactured, for this example, a spinnerette is drilled with 48 filament bore groups, arranged in two concentric circles of 24 holes each and offset so the inner and outer holes do not align, of filament forming bore groups as described in FIG. 1, and above, and nylon 6 (polycaprolactam) polymer is extruded at normal conventional spinning conditions into a quench stack and drawn, taken up onto the package where it is further processed into typical carpet yarn. This carpet yarn is then tufted into a carpet using conventional tufting methods and the face yarn of the carpet is observed to have improved apparent bulk, soil hiding and resiliency. Particularly noteworthy is the improved resiliency compared to normal trilobal carpet yarn fiber having no hollows within each lobe.

The spinnerette of this invention will create a filament or fiber having a cross-section very similar to that of the fiber described in the above mentioned U.S. Pat. No. 3,493,459 except for the absence of the center axial hole. Yet the spinnerette orifices are not a complex set of connecting and/or discontinuous arc-shaped holes but only three straight "Y" shapes which are much easier to make in a spinnerette plate and much easier to maintain in proper clearance tolerance.

We claim:

1. A spinnerette plate for the manufacture of trilobal fiber with a hole in each lobe, said spinnerette having at least one filament forming bore group having a center and said bore group having three openings, each of said openings being "Y" shaped with one short straight leg having an axis and the axis of each short leg converging on the center of the bore group, and said opening having two long straight legs each of the long legs of the same "Y" being divergent from each other by an angle of at least 130° to 150°.

2. The spinnerette plate of claim 1 wherein said divergent angle is 140° and the ratio of the length of one of the long legs to the length of the short leg is between about 3:1 to 15:1.

* * * * *